US005141387A

United States Patent [19]

Smith

[11] Patent Number: 5,141,387

[45] Date of Patent: Aug. 25, 1992

[54] APPARATUS FOR HANDLING DRUMS

[76] Inventor: Barney S. Smith, Box 375 - Township Rd., Rte. 383, Lawrence Township, Newport, Ohio 45768

[21] Appl. No.: 711,320

[22] Filed: Jun. 6, 1991

[51] Int. Cl.[5] ..... B66C 3/16

[52] U.S. Cl. ..... 414/735; 294/88; 294/86.41; 414/739; 414/23

[58] Field of Search ..... 414/23, 735, 739, 620, 414/621, 642; 294/86.41, 88

[56] References Cited

U.S. PATENT DOCUMENTS

| | | | |
|---|---|---|---|
| 2,604,220 | 7/1952 | Frischmann | 414/620 |
| 3,033,397 | 5/1962 | Busch | 414/739 X |
| 3,252,609 | 5/1966 | Ellis | 414/620 |
| 3,438,523 | 4/1969 | Vik | 414/621 X |
| 3,877,743 | 4/1975 | Johnson | 414/735 X |
| 4,005,895 | 2/1977 | Cullings | 414/739 X |
| 4,426,110 | 1/1984 | Mitchell et al. | 294/88 |
| 4,516,905 | 5/1985 | Cavin et al. | 414/620 |
| 4,542,929 | 9/1985 | Possinger | 294/88 |
| 4,921,389 | 5/1990 | O'Daniel | 414/620 X |
| 5,073,080 | 12/1991 | Blum | 414/23 X |

FOREIGN PATENT DOCUMENTS 0157777 12/1982 German Democratic Rep. ... 294/88

*Primary Examiner*—Michael S. Huppert
*Assistant Examiner*—William M. Hienz
*Attorney, Agent, or Firm*—Anthony A. O'Brien

[57] ABSTRACT

A hydraulically operated handler for drums and the like is mounted on the boom of a tractor so as to be selectively pivoted from a vertical position to fifteen degrees past a horizontal position. Grappling arms are mounted on a front plate which is selectively rotatable through 360° by a hydraulic motor. A spindle rotatably supporting the front plate contains hydraulic operating fluid passages which are coupled through a rotating coupling mechanism to hydraulic cylinders operating the grappling arms. The selective pivotal motion together with the ability to selectively rotate the grappling hooks 360° enables effective gripping and handling of drums.

8 Claims, 3 Drawing Sheets

APPARATUS FOR HANDLING DRUMS

BACKGROUND OF THE INVENTION

The present invention relates to apparatus for handling cylindrical objects and particularly to apparatus handling drums containing hazardous materials.

Drums containing hazardous material are often deposited in a haphazard manner at a dump site. The drums can be in any orientation. Because of the hazardous nature and weight of the material in the drums, it is necessary to handle the drums with mechanical lifts or cranes while protecting dump cleanup personnel from exposure to the hazardous material. Various grappling devices can be used. The prior art devices generally have one or more deficiencies such as not being able to control drums in certain orientations, damaging or mishandling the drums to cause the hazardous material to spill, and/or being difficult to operate. The prior art is exemplified by U.S. Pat. Nos. 3,038,620; 3,438,523; 3,438.669; 3,876,100; and 4,243,355. It should be noted that none of the prior art patents has a drum handler which is capable of rotating the drum through 360°.

SUMMARY OF INVENTION

The invention is summarized in an apparatus for handling cylindrical objects including a support for being mounted on a boom which can be raised, lowered, extended, and moved over a horizontal area; the boom having means for pivoting the support to any position between vertical and horizontal positions; a spindle mounted on the support; a member rotatably mounted on the support for rotation through 360°; a motor mounted on the support for rotating the rotatable member on the spindle through 360°; grappling arms mounted on the rotatable member; and means for operating the grappling arms to grip a cylindrical object at any angle relative to the boom and at any orientation from vertical to horizontal.

OBJECTS OF THE INVENTION

An object of the invention is to construct a rotatable and pivotal grappling device for cylindrical objects such as drums and the like wherein the device can be fully rotated through any angle about an axis of rotation which axis can be pivoted to any position between horizontal and vertical orientations.

One advantage of the invention is that a grappling device can be mounted on tractor and moved and positioned to pick up drums haphazardly deposited at a hazardous material dump site with a minimum risk to personnel involved in the cleanup of the hazardous material.

Another object of the invention is to construct a drum handler to operate in a safe and efficient manner for handling hazardous material.

The present invention has another object in that a pair of grappling arms are mounted to grip and rotate a cylindrical object at any orientation from vertical to horizontal.

Another object of the present invention is to provide a grappling device with a rotation through 360°.

This invention has another object in that a drum may be rotated at a variable speed permitting the drum to be emptied at a controlled rate and thus avoid any spillage of the drum contents.

A further object is to provide a handler for a drum or a cylindrical object with a plurality of casters disposed in a circular array between two spaced plates for rotation therebetween.

Additional features of the invention include the provision of a spindle providing rotatable hydraulic connections to enable 360° rotation of grappling arms operated by one or more hydraulic cylinders, the provision of first and second parallel plates wherein the second plate is fully rotatably mounted by a spindle on the first plate and supports grappling arms, and the provision of relatively large diameter rotatable bearing mechanism to minimize stress in supporting grappling arms for heavy drums and the like.

Other objects, advantages and features of the invention will be apparent from the following description of the preferred embodiment and the accompanying drawings.

DETAILED DESCRIPTION

Figure 1:
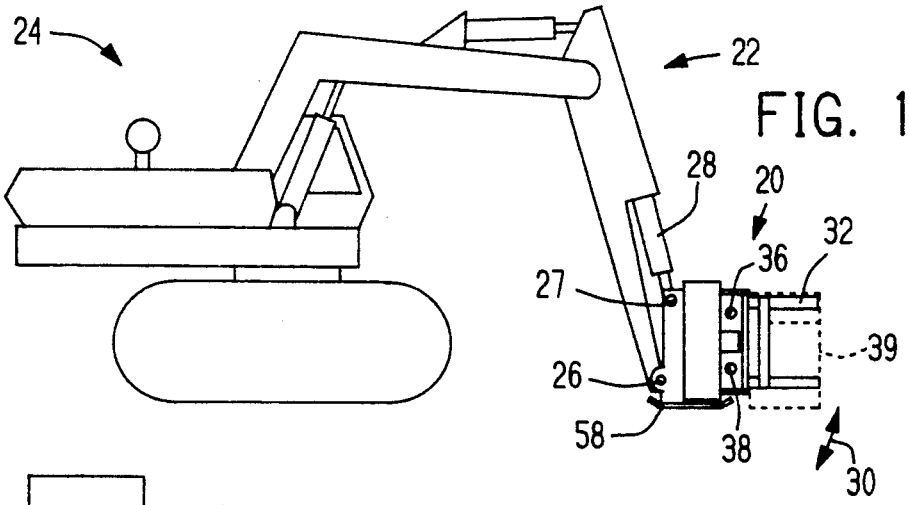
FIG. 1 is side elevational view of an apparatus for grabbing and hanglind drums in accordance with the invention.

As shown in FIG. 1, one embodiment of the invention includes a grappling device indicated generally at 20 pivotally mounted by a pin 26 on a boom indicated generally at 22. The boom 22 in turn is mounted in a conventional manner on a tractor indicated generally at 24 and can be raised, lowered, extended, and moved over an area within reach of the boom around the tractor. Mechanism such as hydraulic cylinder 28 on the boom is connected by a pivot pin 27 to the device 20 for pivoting the device 20 in the direction of the arrowed line 30 from the vertical position of FIG. 1 to any position down to at least a horizontal position and preferably to at least about 15° beyond the horizontal position. Grappling arms 32 and 34, shown partially open in FIG. 2, together with grappling arm operating mechanism such as hydraulic cylinders 36 and 38, see FIG. 3, are mounted on a cylindrical front member or plate 40 of the device 20 for gripping a drum 39. This plate 40 is rotated in the direction of arrowed line 42 by a motor 44 through at least 360° and preferably without limit.

The tractor 24 and boom 22 are conventional equipment normally used with a tool such as a backhoe shovel (not shown) mounted on the end of an articulated boom. Other types of tractors, trucks and booms can be used so long as the grappling device can be pivotally mounted thereon and moved over a desired area.

Figure 2:
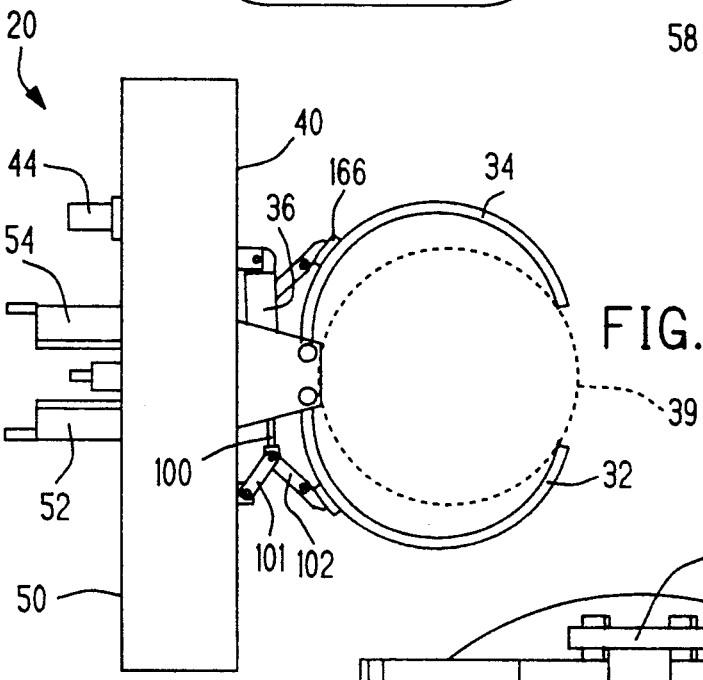
FIG. 2 is a top plan view of a grappling device removed from the apparatus of FIG. 1.
Figure 3:
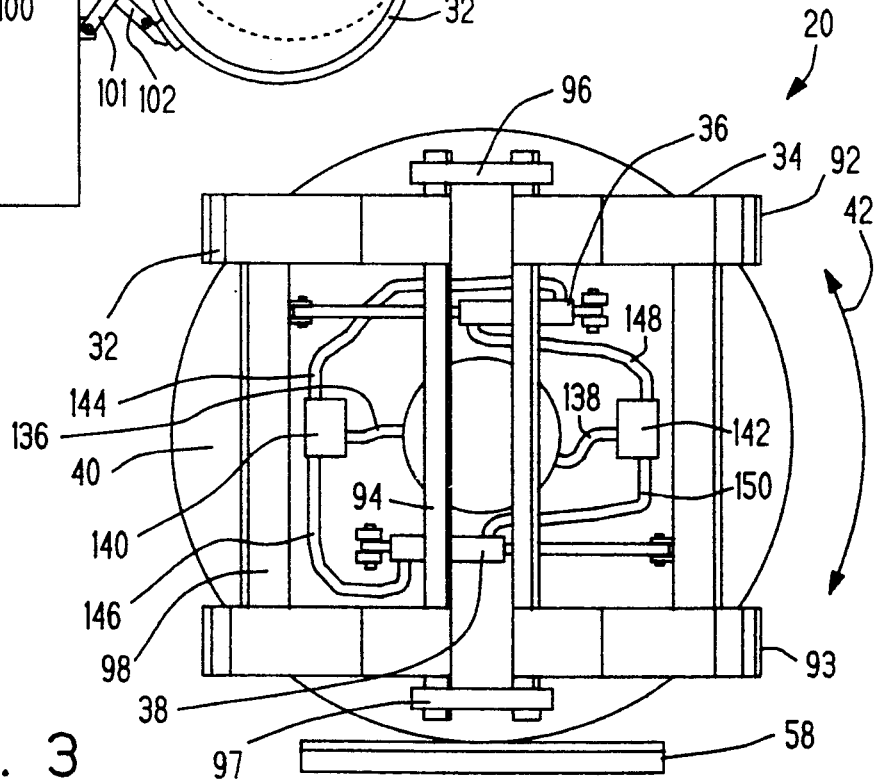
FIG. 3 is a front elevational view of the grappling device of FIG. 2.
Figure 4:
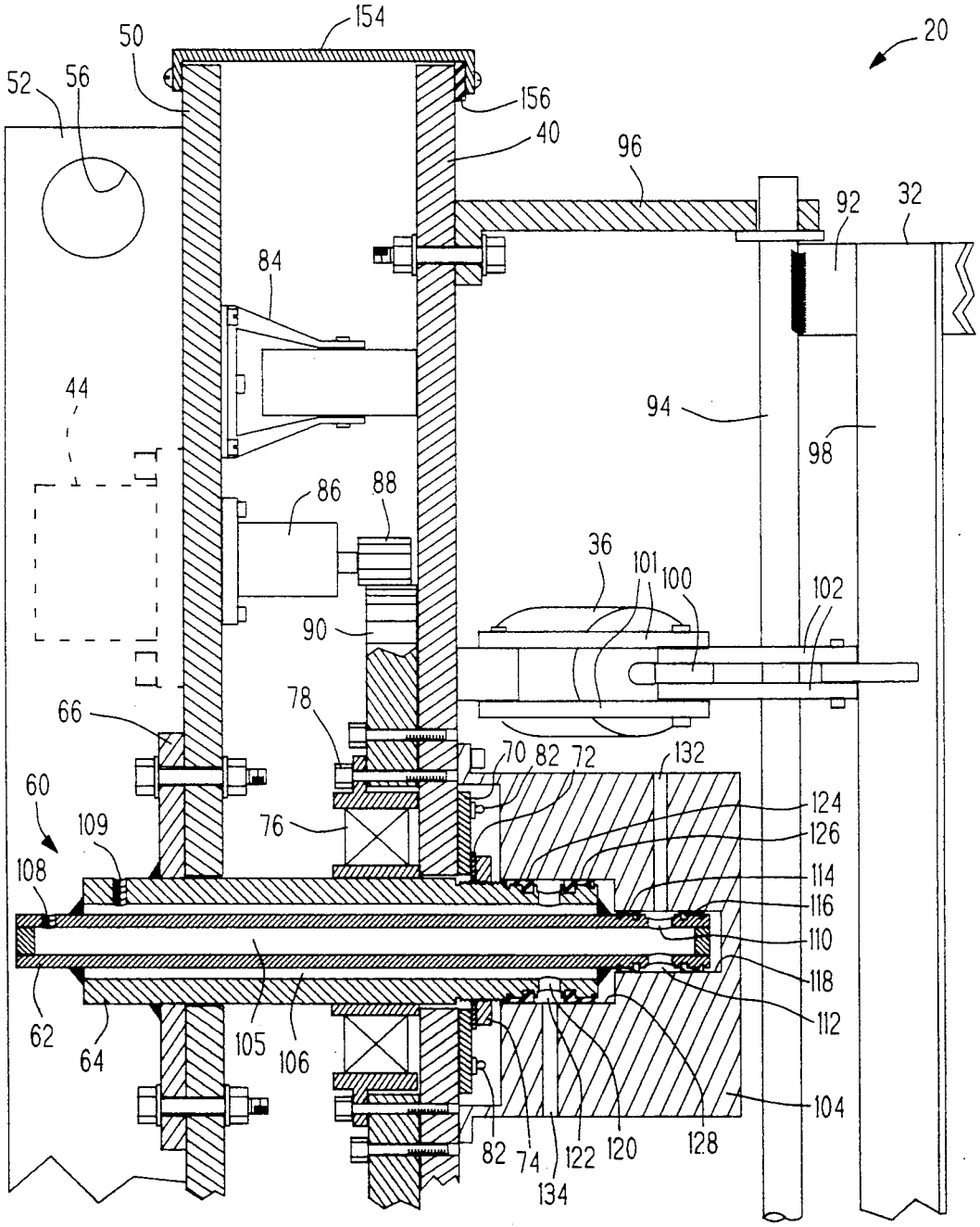
FIG. 4 is a partial detailed side elevational section view of the grappling device of FIGS. 2 and 3.

The grappling device 20 has a circular back plate 50, see FIG. 4, with two vertical mounting members 52 and 54, FIG. 2, welded on the back side of the plate 50 with the width of the members 52 and 54 extending perpendicular to the plate 50. The members 52 and 54 have appropriate lower and upper pivot holes 56 for receiving the pivot pins 26 and 27 mounting the grappling device 20 to the distal end of the boom 22 and the piston rod of cylinder 28. A foot 58 is welded on the bottom of the mounting members 52 and 54 so that the device 20 can rest with the foot 58 engaging the ground to avoid direct engagement of the device 20 with the ground.

Referring to FIG. 4, the circular plates 40 and 50 have substantially equal radii. Extending coaxially through center openings of the plates 40 and 50 is a spindle indicated generally at 60. This spindle includes a hollow shaft 62 secured coaxially within a sleeve 64 with the front and rear ends of the shaft 62 extending past the front and rear ends of the sleeve 64. A flange 66 welded on the sleeve 64 is bolted to the back plate 50. The rear ends of both the shaft 62 and the sleeve 64 extend past the rear of the plate 50 and the front ends of both the shaft 62 and the sleeve 64 extend in front of the front plate 40. The front plate 40 is rotatably secured on the spindle by engagement with a wear plate 70 held by a lock washer 72 and a nut 74 threaded on the sleeve 64. A roller bearing 76 is secured by screws 78 to the center of the plate 40 to provide reduced frictional rotation of the plate 40 on the spindle. Grease fittings 82 enable injection of lubrication between the wear plate 72 and front plate 40. A plurality of casters such as eight casters 84 (only one shown) are mounted on the inside surface of the back plate 50 and have rollers engaging the front plate 40. The casters 84 are evenly spaced in a circular coaxial arrangement at a radius greater than one-half the distance from the center to the outer edge of the plate 50 and preferably about two-thirds of the distance from the center to the outer edge of the plate 50 to provide a large diameter bearing support for the rotating front plate 40.

The motor 44 is mounted in the plate 50 with its shaft extending through a support sleeve 86 mounted on the inside of the plate 50. A gear 88 is mounted on the distal end of the motor shaft and meshes with a gear 90 mounted on the inside surface of the front plate 40 coaxially with the spindle 60 so that operation of the motor rotates the front plate.

As shown in FIG. 3, each of the grappling arms 32 and 34 include upper and lower horizontal arcuate members 92 and 93 welded on a shaft 94, see also FIG. 4, which is pivotally mounted at its upper and lower ends in brackets 96 and 97 mounted on the front plate 40. A vertical cross beam 98 joins the upper and lower members 92 and 93. As shown in FIGS. 2 and 3, each of the hydraulic cylinders 36 and 38 is pivotally mounted on the plate 40 and has a piston rod 100 pivotally connected to the junction of link pairs 101 and 102, see also FIG. 4, which are pivotally connected at their respective other ends to the plate 40 and the cross beam 98 to form toggle joints operated by the hydraulic cylinders 36 and 38 for opening and closing the grappling arms 32 and 34.

A cap 104, FIG. 4, is secured to the plate 40 over the front end of the spindle 60 to prevent dirt from entering the bearing surfaces and to provide rotating hydraulic connections for the hydraulic cylinders 36 and 38. The bore 105 of the center shaft 62 of the spindle 60 is plugged or otherwise closed at both extreme ends. The sleeve 64 is spaced from the shaft 62 to form an annular passage 106 extending through the length of the sleeve and which is closed at its extreme ends by welds. Threaded openings 108 and 109 in the walls of the respective hollow shaft 62 and sleeve 64 near their rear ends provide for hydraulic hose or pipe fittings (not shown) communicating with the respective bore 105 and annular passage 106. Holes 110 in the wall of the hollow shaft 62 near its front end provide communication between the bore 105 and an annular chamber 112 defined between annular rubber seals 114 and 116 mounted on the shaft 62 and engaging the inner wall 118 of a forward cavity in the cap 104. Similarly, holes 120 in the wall of the sleeve 64 near its front end provide communication between the annular passage 106 and an annular chamber 122 defined between annular rubber seals 124 and 126 mounted on the sleeve 64 and the engaging the inner wall 128 of a rear cavity in the cap 104. Threaded openings 132 and 134 are formed in the wall of the cap 104 to receive hydraulic hose or pipe fittings (not shown) for coupling the bore 105 and annular passage 106 to hoses or pipes 136 and 138, FIG. 3, coupled to distributors 140 and 142 which evenly distribute the hydraulic pressure through hoses 144, 146, 148 and 150 to cylinders 36 and 38.

Semi-annular covers 154 are fastened on the back plate 50 and extend over the front plate 40 to close the space between the plates. Seals 156 attached to front lips of the cover 154 engage the front plate 40 to assist in preventing dirt from entering between the plates 40 and 50.

Figure 5:
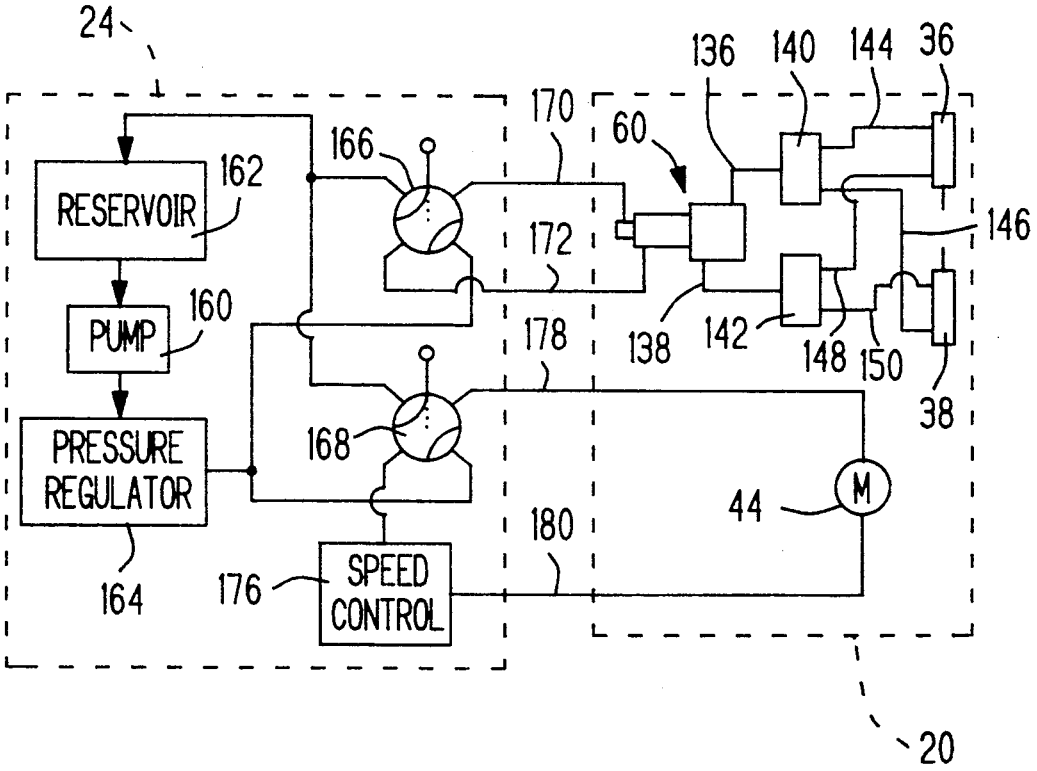
FIG. 5 is a diagrammatic sketch of a hydraulic control circuit of the apparatus of FIG. 1.

The hydraulic control circuit is illustrated in FIG. 5. Pump 160 driven by the motor on the tractor 24 pumps hydraulic fluid from reservoir 162 through pressure regulator to four-way manual control valves 166 and 168. The valve 166 selectively supplies hydraulic pressure to hoses 170 and 172 coupled to the inputs of the spindle 60 to operate the hydraulic cylinders 36 and 38 to open and close the grapple arms 32 and 34. The valve 168 selectively supplies hydraulic pressure to through a speed control 176 and hoses 178 and 180 coupled to the motor 44. The speed control 176 can be adjusted to change the speed of the motor 44. The specifics of the hydraulic control circuit may be varied in order to conform to the hydraulic arrangement of the tractor and/or boom.

It should be noted that the above description is directed towards a drum handler; however, the present invention has many other applications in the lifting, transporting and handling of cylindrical and/or circular objects, such as, telephone poles, trees, tubular pipes, concrete conduits and the like.

Inasmuch as the present invention is subject to many modifications, variations and changes in detail, it is intended that all matter contained in the above description or shown in the accompanying drawings, shall be interpreted as illustrative and not in a limiting sense.

I claim:

1. An apparatus for handling cylindrical objects comprising a support including a first circular plate for being mounted on a boom which can be raised, lowered, extended, and moved over a horizontal area;

said boom having means for pivoting the first circular plate to any position from a vertical position to a horizontal position;

a spindle mounted on the support coaxial with the first circular plate and defining an axis of rotation;

a second circular plate parallel to and spaced from the first circular plate;

a center bearing rotatably mounting the second circular plate on the spindle for rotation through 360° around the axis of rotation;

a plurality of three or more roller means mounted on one of the first and second circular plates and engaging the other circular plate to provide large diameter bearing support between the first and second circular plates:

an annular cover extending over the peripheries of the first and second circular plates to prevent dirt from entering between the first and second circular plates;

a motor mounted on the support for rotating the second circular plate on the spindle through 360° grappling arms mounted on the second circular plate; and means for operating the grappling arms to grip a cylindrical object at any orientation from vertical to horizontal and at any angle relative to the boom.

2. An apparatus as claimed in claim 1 wherein the grappling arm operating means includes hydraulic cylinder means, the spindle includes a pair of passages for hydraulic fluid, and the apparatus includes rotating fluid coupling means for coupling the pair of passages in the spindle to the grappling arm hydraulic cylinder means.

3. An apparatus as claimed in claim 1 wherein the first and second plates have substantially similar radii from the axis of rotation, and the roller means includes a plurality of casters mounted in a circular arrangement at a radius from the axis of rotation greater than one-half the radii of the plates.

4. An apparatus as claimed in claim 2 wherein the rotating fluid coupling means includes seal means rotatably engaging the spindle to provide a pair of hydraulic fluid coupling paths.

5. An apparatus for handling cylindrical objects comprising a support including a first circular plate for being mounted on a boom which can be raised, lowered, extended, and moved over a horizontal area:

said boom having means for pivoting the first circular plate to any position from a vertical position to a horizontal position;

a spindle mounted on the support coaxial with the first circular plate;

a second circular plate coaxial with the spindle and rotatably mounted on the spindle for rotation through 360°;

a motor mounted on the support for rotating the second circular plate on the spindle through 360°;

grappling arms mounted on the second circular plate;

hydraulic cylinder means for operating the grappling arms to grip a cylindrical object at any orientation from vertical to horizontal and at any angle relative to the boom;

said spindle having a front end extending to the front of the second circular plate with a pair of hydraulic fluid passages communicating with respective axially spaced side wall openings in the spindle; and rotating fluid coupling means for coupling the pair of passages in the spindle to the grappling arm hydraulic cylinder means;

said rotating fluid coupling means including a cap mounted on the front of the second circular plate over the front end of the spindle with side wall bores in the cap aligned with the respective side wall openings in the spindle, and seal means forming a pair of annular chambers around the spindle communicating with the respective side wall openings in the spindle and the respective side wall bores in the cap.

6. An apparatus as claimed in claim 5 including an annular cover extending over the peripheries of the first and second circular plates to prevent dirt from entering between the first and second circular plates.

7. An apparatus as claimed in claim 1 wherein the motor is mounted on the first plate and has a shaft with a first gear extending adjacent the second plate, and the apparatus includes a second gear mounted on the second plate coaxially with the axis of rotation and meshing with the first gear.

8. A hydraulic drum grappling device comprising a first circular plate;

mounting means on the first plate for enabling attachment of the first plate to a tractor boom which can be raised, lowered, extended, and moved over a horizontal area;

said boom having hydraulic cylinder means connected to the mounting means for pivoting the first plate to any position between vertical and horizontal planes;

a spindle having a radially extending flange mounted on the first circular plate so that the spindle extends in front of the first circular plate coaxially with the first circular plate;

a second circular plate having a radius similar to the radius of the first plate and having a center bearing rotatably mounting the second circular plate on the spindle in front of and coaxially with the first plate;

a wear plate engaging the front of the second plate;

a nut threaded on the front end of the spindle for securing the wear plate and second circular plate on the spindle;

a plurality of casters mounted between the plates in an evenly spaced circular arrangement coaxial with the spindle and spaced at least one-half the radius of the plates from the spindle for providing rolling support for the second plate;

a first gear coaxially mounted on the second plate;

a hydraulic motor mounted on the first plate and having a shaft with a second gear meshing with the first gear for rotating the second plate;

means for coupling the motor to hydraulic operating hoses from a tractor;

upper and lower brackets mounted on the front of the first plate;

a pair of grappling arms each having upper and lower horizontal arcuate members with a vertical cross beam and a vertical shaft pivotally mounted at upper and lower ends in the respective upper and lower brackets;

a pair of hydraulic cylinders pivotally mounted on the front of the second plate and having respective piston rods;

a pair of toggle joints each having a first end pivotally connected to the second plate, a second end pivotally connected to the respective cross beam of the grappling arm, and a common pivot joint connected to the respective piston rod so that operation of the hydraulic cylinders operates the grappling arms to open or close the grappling arms;

said spindle including a hollow shaft defining a central bore and a sleeve coaxially surrounding the shaft in spaced relationship to define an annular passage between the shaft and the sleeve extending from the rear of the first plate to the front of the second plate;

said sleeve having a first side wall opening in front of the second plate and communicating with the annular passage;

said hollow shaft extending past the front of the sleeve and having a second side wall opening in front of the sleeve and communicating with the central bore;

means for coupling hydraulic operating hoses from the tractor to the respective bore and annular passage on the rear of the first plate;

a cap mounted on the front of the second plate coaxially over the forward ends of the hollow shaft and sleeve of the spindle and having a pair of bores in the side wall of the cap aligned with the respective first and second side wall openings;

pairs of seal means mounted on the respective sleeve and hollow shaft and slidingly engaging interior surfaces of the cap to form respective annular chambers around the sleeve and hollow shaft providing communication paths from the first and second side wall openings to the respective bores in the side wall of the cap; and hose and distributor means coupling the bores in the side wall of the cap to the pair of hydraulic cylinders on the front of the second plate.

* * * * *